US005724017A

United States Patent [19]

Pla et al.

[11] Patent Number: 5,724,017

[45] Date of Patent: Mar. 3, 1998

[54] ELECTRICAL TRANSFORMER WITH REDUCED CORE NOISE

[75] Inventors: Frederic Ghislain Pla, Clifton Park; Imdad Imam, Schenectady, both of N.Y.; Frank Albert Pitman, Jr., Rome, Ga.; Stephen Linwood Smith, Garza Garcia, Mexico

[73] Assignee: General Electric Company, Schenectady, N.Y.

[21] Appl. No.: 509,265

[22] Filed: Jul. 31, 1995

[51] Int. Cl.[6] ..... H01F 27/00

[52] U.S. Cl. ..... 336/100; 336/92

[58] Field of Search ..... 336/65, 66, 68, 336/90, 92, 94, 100

[56] References Cited

U.S. PATENT DOCUMENTS

| | | | |
|---|---|---|---|
| 3,629,757 | 12/1971 | Katayama | 336/55 |
| 4,318,068 | 3/1982 | Hori | 336/100 |
| 4,371,858 | 2/1983 | Kanoi et al. | 336/100 |
| 4,390,858 | 6/1983 | Schulzer | 336/92 |

OTHER PUBLICATIONS

"Active Noise Control Systems", by R.R. Leitch and M.O. Tokhi, IEEE Proceedings, vol. 134, Pt. A, No. 6, Jun. 1987, pp. 525, 528, and 545.

*Primary Examiner*—Matthew V. Nguyen
*Attorney, Agent, or Firm*—Douglas E. Erickson; Marvin Snyder

[57] ABSTRACT

An electrical transformer includes a housing, a transformer core and winding subassembly located within the housing, and an active mount subassembly having an active mount and a controller. The active mount has a first end attached to the housing and a second end attached to the transformer core and winding subassembly. The controller has an output port connected to the active mount. The active mount cancels out (or reduces) noise-causing vibrations which come from the transformer core and winding subassembly during transformer operation.

10 Claims, 2 Drawing Sheets

ELECTRICAL TRANSFORMER WITH REDUCED CORE NOISE

BACKGROUND OF THE INVENTION

The present invention relates generally to electrical transformers, and more particularly to electrical transformers having lower noise levels.

Electrical transformers are well known and normally include a transformer core and winding subassembly placed in a housing. For large transformers, a typical housing includes a tank containing transformer fluid (e.g., mineral oil) which electrically insulates and absorbs heat from the immersed transformer core and winding subassembly. Vanes attached to the tank transfer such heat to the atmosphere, with such heat transfer usually aided by cooling fans blowing against the vanes.

Noise from transformers used by utility companies and industries is often a problem, especially in urban areas. Such noise includes the narrowband noise from the transformer core which occurs at harmonics of the line frequency and also includes the noise from the transformer cooling fans. As communities have become more sensitive to noise pollution issues, transformer manufacturers have designed quieter transformers. A conventional passive approach to the reduction of transformer core noise is to add mass to the transformer core. Unfortunately, such quieter transformers have a larger core cross-sectional area which results in a significant increase in cost and weight. Noise from transformer cooling fans typically has been reduced passively by using lower tip-speed and larger diameter fans with low-noise blade designs.

In an effort to reduce cost and weight in a quieter transformer, several active noise control methods (i.e., methods which introduce noise or vibrations equal in amplitude and opposite in phase to the offending noise or vibrations) have been proposed in the literature. In one approach, loudspeaker sources are used to actively cancel noise from the transformer. In another approach, transformer noise is reduced by actively canceling the noise-inducing vibrations of the transformer tank through piezoceramic actuators bonded directly to the transformer tank. In an additional approach, piezoceramic actuators are bonded to noise radiating panels mounted close to the transformer tank to actively cancel transformer noise. What is needed is an improved low-noise electrical transformer.

SUMMARY OF THE INVENTION

It is an object of the invention to provide an electrical transformer having reduced noise.

The electrical transformer of the invention includes a housing, a transformer core and winding subassembly positioned within and spaced apart from the housing, and an active mount subassembly. The active mount subassembly includes an active mount and a controller. The active mount has a first end attached to the housing and a second end attached to the transformer core and winding subassembly for canceling oscillations of the housing. The controller has an output port connected to the active mount.

In an exemplary embodiment, the active mount subassembly also includes a vibration sensor, and the controller also has an input port connected to the vibration sensor. Preferably, the vibration sensor is mounted on and near the first end of the active mount, or the vibration sensor is mounted on and outside the housing near the active mount.

Several benefits and advantages are derived from the invention. The controller uses the input from the vibration sensor to control the movements of the active mount to cancel out (or reduce) vibrations in the housing caused by vibration/noise being transmitted from the transformer core and winding subassembly. Better noise control is achieved because active noise control is being performed closer to the source of the noise compared to conventional active-noise-control proposed techniques involving directly vibrating the housing or using noise-canceling loudspeakers outside the housing.

BRIEF DESCRIPTION OF THE DRAWINGS

The accompanying drawings illustrate a preferred embodiment of the present invention wherein.

DETAILED DESCRIPTION OF THE INVENTION

Figure 1:
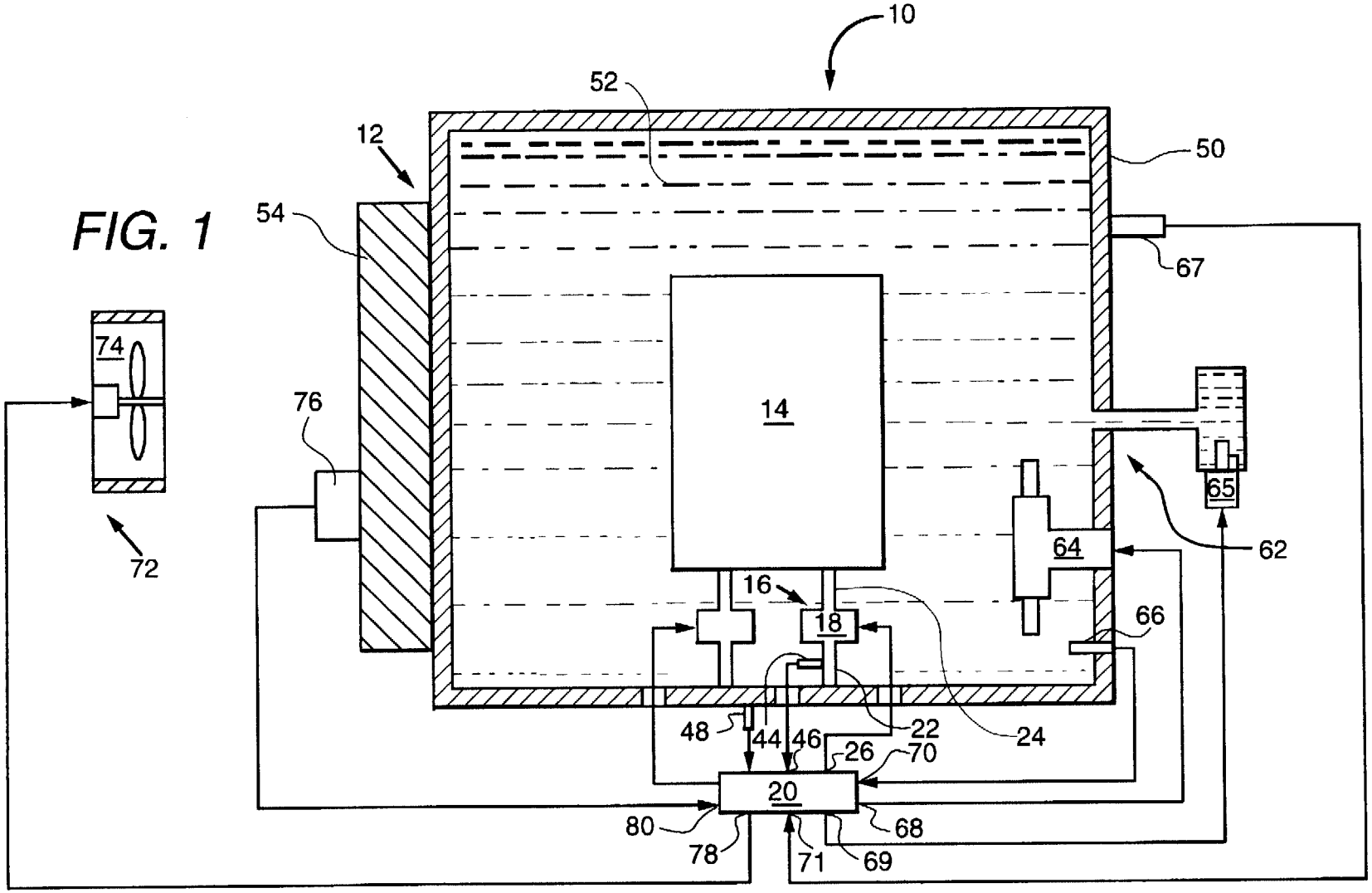
FIG. 1 is a schematic view of a preferred embodiment of the electrical transformer of the invention with lines having arrowheads representing signal paths.
Figure 3:
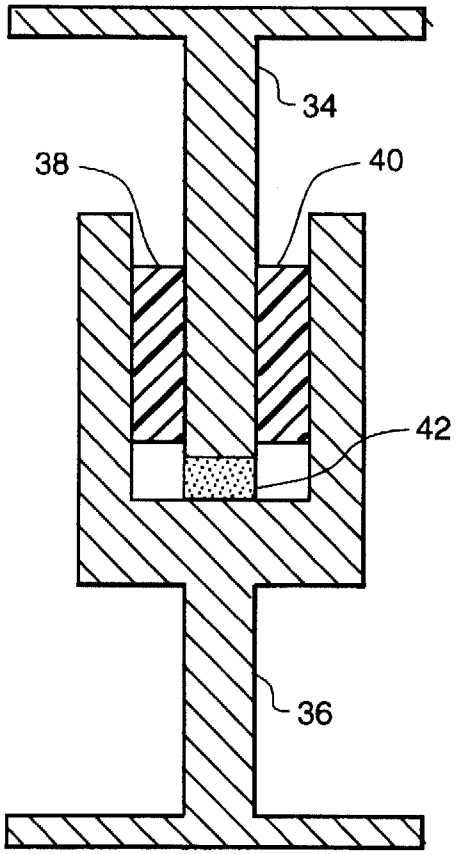
FIG. 3 is a schematic view of a preferred "one-dimensional" embodiment of the active mount schematically represented in FIG. 2.
Figure 2:
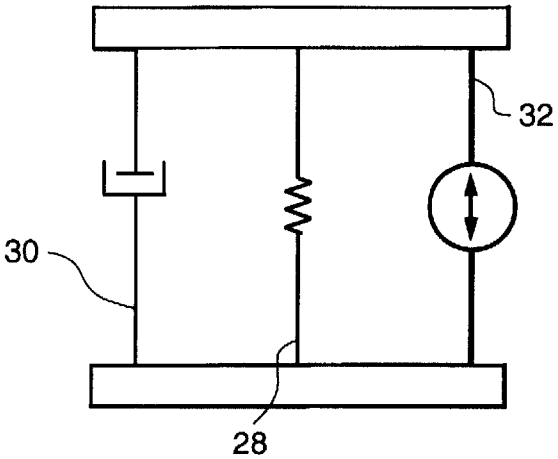
FIG. 2 is a "one-dimensional" schematic representation of an active mount.

Referring now to the drawings, wherein like numerals represent like elements throughout, FIGS. 1–3 show a preferred embodiment of the electrical transformer 10 of the present invention. The electrical transformer 10 can be any type of electrical transformer such as, but not limited to, a power transformer used at a generating station to step up the generated voltage to high levels for transmission, a pole-type distribution transformer used in a neighborhood to step down the transmitted voltage to low levels for residences, etc. The electrical transformer 10 of the invention is a reduced-noise electrical transformer.

In a first preferred embodiment of the invention, the electrical transformer 10 includes a housing 12, a transformer core and winding subassembly 14, and an active mount subassembly 16. The transformer core and winding subassembly 14 is disposed within and spaced apart from the housing 12. The active mount subassembly 16 includes an active mount 18 and a controller 20. The active mount 18 has a first end 22 attached to the housing 12 and a second end 24 attached to the transformer core and winding subassembly 14 for canceling oscillations of the housing 12. The controller 20 has an output port 26 connected to the active mount 18.

For the purpose of describing the invention, the terminology "active mount" is defined to be a mount which can support a vibrating first member (e.g., a transformer core and winding subassembly 14) from a second member (e.g., a housing 12) and which itself can be controllably oscillated to reduce the vibrations of the second member. A "one-dimensional" representation of the active mount 18 of FIG. 1 is schematically illustrated in FIG. 2 and includes a support element 28, a damping element 30, and an oscillatory driving element 32. A typical "one-dimensional" embodiment of the active mount 18 of FIG. 1 is shown in FIG. 3 and includes a first support member 34 attached to a second support member 36 by two rubber pieces 38 and 40 which provide support and damping and further includes a piezoceramic member 42 as the oscillatory driving element. Other oscillatory driving elements include fluidic or electrodynamic elements, as can be appreciated by the artisan. It is noted that two or three "one-dimensional" active mounts may be arranged to provide active mounting along two or three orthogonal directions. Other active mounts include shakers and other active vibratory motion isolation arrangements, as can be provided by the artisan.

The transformer core and winding subassembly 14 can have any core and winding arrangement for a transformer, as can be appreciated by those skilled in the art. For example, winding arrangements include, without limitation, concentric and interleaved. Also, core arrangements include, without limitation, shell form and core form.

Preferably, the active mount subassembly 16 also includes a vibration sensor 44, and wherein the controller 20 also has an input port 46 connected to the vibration sensor 44. In a first preferred construction, the vibration sensor 44 is mounted on and proximate the first end 22 of the active mount 18. In a second preferred construction, the active mount subassembly 16 has a vibration sensor 48 which is mounted on and outside the housing 12 and which is disposed proximate the active mount 18.

Typically, the active mount 18 cancels oscillations of the housing 12 along three orthogonal axes. In a particular application, when it is known that the transformer core and winding subassembly 14 vibrates predominantly along two orthogonal directions, the active mount 18 need cancel oscillations of the housing 12 only along those two orthogonal directions. Likewise, in a specific application, when it is known that the transformer core and winding subassembly 14 vibrates predominantly along one direction, the active mount 18 need cancel oscillations of the housing 12 only along that one direction.

Preferably, the controller 20 is a feedback controller such as a programmed digital computer. In one embodiment, the active-mount computer program is a computer feedback control program which sends an actuation signal through the controller's output port 26 to the active mount 18 to generate an oscillatory force equal in amplitude and opposite in phase to the vibration/noise force applied by the transformer core and winding subassembly 14 to cancel out (or reduce) the noise-causing vibrations of the transformer core and winding subassembly 14 which are sensed by the vibration sensor 44 which sends a signal through the controller's input port 46 to be used by the computer feedback control program in calculating the actuation signal. Such computer feedback control programs are well known and within the skill level of the artisan.

In a preferred construction, the housing 12 comprises a tank 50 containing transformer fluid 52 (e.g., mineral oil). The transformer core and winding subassembly 14 is disposed in the transformer fluid 52 within and spaced apart from the tank 50, and the active mount 18 is disposed in the transformer fluid 52 within the tank 50. The transformer fluid 52 electrically insulates and absorbs heat from the immersed transformer core and winding subassembly 14. The housing 12 further comprises vanes 54 attached to the tank 50 to help dissipate heat, as can be appreciated by those skilled in the art.

In a second preferred embodiment of the invention, the electrical transformer 10 includes a tank 50 and a transformer core and winding subassembly 14. The tank 50 contains transformer fluid 52, and the transformer core and winding subassembly 14 is disposed in the transformer fluid 52 within and spaced apart from the tank 50. The electrical transformer 10 also includes means 62 for varying the dynamic pressure of the transformer fluid 52 within the tank 50 during electromagnetic operation of the transformer core and winding subassembly 14.

The dynamic-pressure-varying means 62 includes a dynamic pressure actuator 64 or 65, a sensor 66 or 67, and a controller which preferably is the controller 20 used in the active mount subassembly 16 with the inclusion of a dynamic-pressure-varying subroutine to the active-mount computer program. Such dynamic-pressure-varying subroutine would use the input from the sensor 66 or 67 to send a control signal to the dynamic pressure actuator 64 or 65 to create dynamic pressure oscillations in the transformer fluid 52 to cancel out (or reduce) those vibrations in the transformer fluid 52 caused by the operating transformer core and winding subassembly 14. The writing of such a subroutine is within the skill of the artisan. Dynamic pressure actuators 64 and 65 include, without limitation, low-power piezoceramic flextensional transducers originally developed for underwater applications, electrodynamic actuators, hydraulic actuators, and pumps powered by such piezoelectric, electrodynamic, or hydraulic transducers/actuators. These dynamic pressure actuators 64 and 65 are used to apply a controllably varying dynamic pressure to the transformer fluid 52 to cancel out (or reduce) the noise-causing vibrations of the transformer fluid 52 which are generated by vibrations of the transformer core and winding subassembly 14 during electromagnetic operation of the transformer core and winding subassembly 14.

In a first preferred construction, the dynamic pressure actuator 64 is disposed in the transformer fluid 52 within the tank 50, and the sensor 66 is a dynamic pressure sensor disposed in the transformer fluid 52 within the tank 50 proximate the dynamic pressure actuator 64. Preferably, the controller 20 has an output port 68 connected to the dynamic pressure actuator 64 and an input port 70 connected to the dynamic pressure sensor 66. In a second preferred construction, the dynamic pressure actuator 65 is disposed outside the tank 50 and in fluid communication with the transformer fluid 52 within the tank 50, and the sensor 67 is a vibration sensor mounted on and outside the tank 50. Preferably, the controller 20 has an output port 69 connected to the dynamic pressure actuator 65 and an input port 71 connected to the vibration sensor 67.

It is preferred, for particular applications, to include an exemplary active mount subassembly in the electrical transformer 10 having the dynamic-pressure-varying means 62. Here, the electrical transformer 10 of the previously-described second preferred embodiment of the present invention would additionally comprise the active mount subassembly 16. The active mount subassembly 16 includes the active mount 18, having its first end 22 attached to the tank 50 and its second end 24 attached to the transformer core and winding subassembly 14, and also includes the controller 20 having the output port 26 connected to the active mount 18. The active mount subassembly 16 further includes its vibration sensor 44 mounted on and proximate the first end 22 of the active mount 18 and additionally includes the controller 20 having its input port 46 connected to the vibration sensor 44. When the transformer core and winding subassembly 14 vibrates predominantly along one direction, the active mount 18 cancels oscillations of the housing 12 only along that one direction.

In a third preferred embodiment of fie invention, the electrical transformer 10 includes a housing 12, a transformer core and winding subassembly 14 disposed within and spaced apart from the housing 12, and a cooling fan subassembly 72. The cooling fan subassembly 72 includes a variable speed fan 74, a temperature sensor 76, and a controller which preferably is the controller 20 used in the active mount subassembly 16 with the inclusion of a fan-speed-varying subroutine to the active-mount computer program. Such fan-speed-varying subroutine would use the input from the temperature sensor 76 to send a control signal to the variable speed fan 74 to reduce the speed of the variable speed fan 74 (which reduces the noise from the variable speed fan 74) when a desired temperature, as measured by the temperature sensor 76, can be maintained with a lower fan speed. The writing of such a subroutine is within the skill of the artisan. The variable speed fan 74 is disposed outside the housing 12 and aligned to move air between the variable speed fan 74 and the housing 12. The temperature sensor 76 is disposed proximate the housing 12. The controller 20 has an output port 78 connected to the variable speed fan 74 and has an input port 80 connected to the temperature sensor 76.

In an exemplary embodiment, the variable speed fan 74 is aligned to move air from the variable speed fan 74 to the housing 12. Preferably, the housing 12 includes a tank 50 containing transformer fluid 52 and vanes 54 attached to the tank 50. In this arrangement, the variable speed fan 74 is aligned to move air from the variable speed fan 74 to the vanes 54. It is preferred that the temperature sensor 76 is disposed between the variable speed fan 74 and the housing 12. A desirable location is to have the temperature sensor 76 mounted on the housing 12, such as being mounted on one of the vanes 54 of the housing 12.

It is preferred, in some applications, to include an exemplary active mount subassembly in the electrical transformer 10 having the cooling fan subassembly 72. Here, the electrical transformer 10 of the previously-described third preferred embodiment of the present invention would additionally comprise the active mount subassembly 16. The active mount subassembly 16 includes the active mount 18, having its first end 22 attached to the housing 12 and its second end 24 attached to the transformer core and winding subassembly 14, and also includes the controller 20 having the output port 26 connected to the active mount 18. The active mount subassembly 16 further includes its vibration sensor 44 mounted on and proximate the first end 22 of the active mount 18 and additionally includes the controller 20 having its input port 46 connected to the vibration sensor 44.

It is preferred, in other applications, to have the housing 12 comprise a tank 50 containing transformer fluid 52 and to have the transformer core and winding subassembly 14 be disposed in the transformer fluid 52 within and spaced apart from the tank 50. The electrical transformer 10 of the previously-described third preferred embodiment of the present invention would additionally comprise the means 62 for varying the dynamic pressure of the transformer fluid 52 within the tank 50 during electromagnetic operation of the transformer core and winding subassembly 14. Preferably, the means 62 includes a dynamic pressure actuator 64 disposed in the transformer fluid 52 within the tank 50 and further includes a dynamic pressure sensor 66 disposed in the transformer fluid 52 within the tank 50 proximate the dynamic pressure actuator 64. In an exemplary embodiment, the active mount subassembly 16 is added to the electrical transformer 10 described in this paragraph. Preferably, the active mount subassembly 16 includes an active mount 18 having its first end 22 attached to the tank 50 and having its second end 24 attached to the transformer core and winding subassembly 14. Here, the controller 20 has an output port 26 connected to the active mount 18. It is also preferred that the active mount subassembly 16 also include a vibration sensor 44 mounted on and proximate the first end 22 of the active mount 18 and that the controller 20 have an input port 46 connected to the vibration sensor 44.

The foregoing description of several preferred embodiments of the invention has been presented for purposes of illustration. It is not intended to be exhaustive or to limit the invention to the precise form disclosed, and obviously many modifications and variations are possible in light of the above teaching. For example, the electrical transformer 10 of the invention may have any number of active mounts 18 or active mount subassemblies 16, dynamic pressure actuators 64 and 65 or dynamic-pressure-varying means 62, and/or variable speed fans 74 or cooling fan subassemblies 72, depending on the particular transformer application, as can be understood by those skilled in the art. It is intended that the scope of the invention be defined by the claims appended hereto.

We claim:

1. An electrical transformer comprising:

a) a housing;

b) a transformer core and winding subassembly disposed within and spaced apart from said housing;

c) an active mount subassembly including:

(1) an active mount disposed within said housing and having a first end attached to said housing and a second end attached to said transformer core and winding subassembly for canceling oscillations of said housing; and (2) a controller having an output port connected to said active mount.

2. The electrical transformer of claim 1, wherein said active mount subassembly also includes a vibration sensor and wherein said controller also has an input port connected to said vibration sensor.

3. The electrical transformer of claim 2, wherein said vibration sensor is mounted on and proximate said first end of said active mount.

4. The electrical transformer of claim 2, wherein said vibration sensor is mounted on and outside said housing.

5. The electrical transformer of claim 4, wherein said vibration sensor is disposed proximate said active mount.

6. The electrical transformer of claim 1, wherein said active mount cancels oscillations of said housing along three orthogonal axes.

7. The electrical transformer of claim 1, wherein said transformer core and winding subassembly vibrates predominantly along two orthogonal directions and wherein said active mount cancels oscillations of said housing only along said two orthogonal directions.

8. The electrical transformer of claim 1, wherein said transformer core and winding subassembly vibrates predominately along one direction and wherein said active mount cancels oscillations of said housing only along said one direction.

9. The electrical transformer of claim 1, wherein said controller is a feedback controller.

10. The electrical transformer of claim 1, wherein said housing comprises a tank containing transformer fluid, wherein said transformer core and winding subassembly is disposed in said transformer fluid within and spaced apart from said tank, and wherein said active mount is disposed in said transformer fluid within said tank.

* * * * *